United States Patent [19]

Hanayama et al.

[11] Patent Number: 4,558,335

[45] Date of Patent: Dec. 10, 1985

[54] THERMORESPONSIVE RECORDING SHEET

[75] Inventors: Naoki Hanayama, Oita; Eisaburo Kaku, Shiga; Ryoichi Kinishi, Nara, all of Japan

[73] Assignee: Yoshitomi Pharmaceutical Industries, Ltd., Osaka, Japan

[21] Appl. No.: 357,113

[22] Filed: Mar. 11, 1982

[30] Foreign Application Priority Data

Mar. 11, 1981 [JP] Japan ..... 56-35619

[51] Int. Cl.[4] ..... B41M 5/18

[52] U.S. Cl. ..... 346/209; 346/216; 346/221; 346/225; 427/150; 427/151

[58] Field of Search ..... 106/21; 282/27.5; 427/150, 151, 152; 428/320.4, 320.6, 320.8, 488, 537, 913, 914; 346/209, 216, 221, 225

[56] References Cited

U.S. PATENT DOCUMENTS 3,539,375 11/1970 Baum ..... 428/537

FOREIGN PATENT DOCUMENTS 1531121 11/1978 United Kingdom ..... 346/209

*Primary Examiner*—Bruce H. Hess

*Attorney, Agent, or Firm*—Sughrue, Mion, Zinn, Macpeak & Seas

[57] ABSTRACT

There is disclosed the use of benzyl 4-benzyloxybenzoate as a responsiveness-increasing agent in a thermoresponsive recording paper sheet comprising a normally colorless or pale-colored chromogenic substance in combination with a phenolic compound.

6 Claims, 1 Drawing Figure

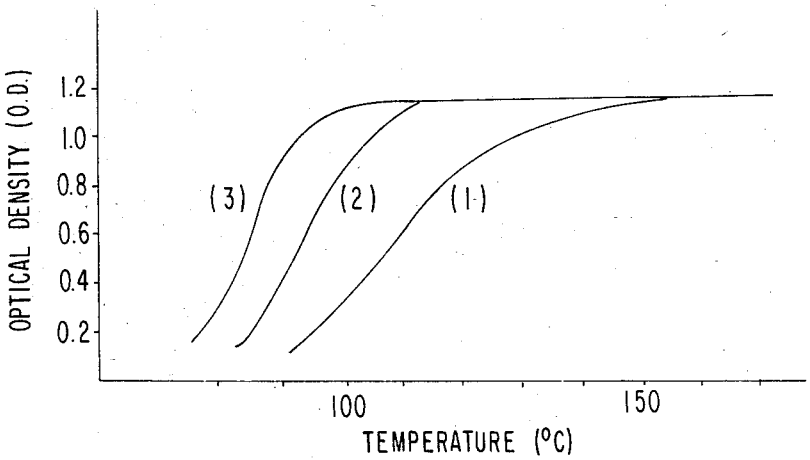
OPTICAL DENSITY (O.D.)
1.2
1.0
0.8
0.6
0.4
0.2
(3)
(2)
(1)
100
150
TEMPERATURE (°C)

THERMORESPONSIVE RECORDING SHEET

This invention relates to a thermoresponsive recording paper sheet. More particularly, the invention relates to a thermoresponsive recording paper sheet comprising a colorless or pale-colored chromogenic substance in combination with a phenolic compound, characterized in that the thermoresponsive recording layer thereof further contains benzyl 4-benzyloxybenzoate.

It has long been known that colorless or pale-colored chromogenic substances, such as crystal violet lactone, and phenolic compounds can react to produce a color, and the use of such reaction in thermoresponsive paper sheet recording is disclosed in U.S. Pat. No. 3,539,375, for instance.

However, to meet the demands for higher thermal sensitivity and high-speed responsiveness, for instance, arising from recent advances in recording devices and diversified use of thermoresponsive recording sheets, it is still necessary to solve various problems. For instance, for use on thermal printers or thermal facsimile telegraphs, thermoresponsive paper sheets should have improved thermal responsiveness in color production, since an insufficient degree of responsiveness would result in increased electric power consumption and/or decreased printing velocity. For increasing color-producing responsiveness of thermoresponsive sheets, there has already been proposed the use of such additives as waxes (Japanese Patent Application laid open (Kokai) under No. 19,231/1973), nitrogen-containing compounds (Japanese Kokai No. 34,842/1974) and acetoacetanilide (Japanese Kokai No. 106,746/1977), among others.

In thermoresponsive recording sheets, presumably a chromogenic substance and a phenolic compound are present each in the stable and finely divided state dispersedly in the same layer or in different layers and, when heated, at least one of the two components melts or both give an eutectic mixture, whereby they come into intimate contact with each other to produce a color.

U.S. Pat. No. 3,539,375 describes as a phenolic compound adequate for such purpose 4,4'-isopropylidenediphenol (m.p. 156° C.), which is used today in many cases. However, a considerably high temperature (e.g. 140°–150° C.) is required for distinct color production as a result of its melting. To cope with the development of high-speed recording devices as mentioned above, those thermoresponsive recording sheets with improved responsiveness which are capable of responding to a lower temperature (e.g. 80°–120° C.) to produce a distinct color are desired. The use of the above-mentioned waxes and so on is poor in practicability since they are water-soluble or the chromogenic substance and/or phenolic compound is scarcely soluble in them.

As a result of intensive research to improve the responsiveness in color production while removing the above-mentioned drawbacks, the present inventors have found a practicable and widely applicable method of improving said responsiveness. In accordance with the present which has now been completed, benzyl 4-benzyloxybenzoate is used as an additive in the thermoresponsive layer containing at least one colorless or pale-colored chromogenic substance and at least one phenolic compound combinedly.

The "chromogenic substance" as used herein means a compound capable of producing a color upon reaction with a phenolic compound and includes, among others, crystal violet lactone, malachite green lactone, 3,3-bis(p-dimethylaminophenyl)-4,5,6,7-tetrachlorophthalide, benzo$\beta$-naphthospiropyran, 3-methyl-di-$\beta$-naphthospiropyran, 1,3,3-trimethyl-6'-chloro-8'-methoxyindolinobenzospiropyran, N-phenylrhodamine lactam, 3-ethylamino-6-chlorofluoran, 3-morpholino-5,6-benzofluoran, 3-diethylamino-6-methyl-7-anilinofluoran, 3-diethylamino-6-methyl-7-chlorofluoran, 3-diethylamino-6,7-dimethylfluoran, 3-dimethylamino-7,8-benzofluoran, 3-diethylamino-7-dibenzylaminofluoran, 3-diethylamino-7-anilinofluoran, 3-diethylamino-5,6-benzo-7-benzylaminofluoran, 3-piperidino-6-methyl-7-anilinofluoran, 3-pyrrolidino-6-methyl-7-anilinofluoran, 3-N-ethyl-N-tolylamino-6-methyl-7-anilinofluoran and 3-diethylamino-7-N-(3-trifluoromethylphenyl)aminofluoran, but is not limited to these.

The phenolic compound should melt generally at 70° C. or above and thereby react with the above-mentioned colorless or pale-colored chromogenic substance to produce a color and includes, but is not limited to, 4-phenylphenol, 4-methyl-2,6-di-tert-butylphenol, 4,4-dihydroxydiphenyl, 4,4'-isopropylidenediphenol, 4,4'-isopropylidenebis(2-chlorophenol), 4,4'-isopropylidenebis(2-methylphenol), 4,4-isopropylidenebis(2-tert-butylphenol), 4,4'-isopropylidenebis(2,6-dimethylphenol), 4,4'-sec-butylidenediphenol, 4,4'-cyclohexylidenediphenol, 4,4'-cyclohexylidenebis(2-methylphenol), 4,4'-cyclohexylidenebis(2-isopropylphenol), 2,2'-methylenebis(4-chlorophenol), 2,2'-methylenebis(4-methyl-6-tert-butylphenol), 2,2-bis(4-hydroxyphenyl)hexane, 2,2-bis(4-hydroxyphenyl)heptane, 2,2-bis(4-hydroxyphenyl)octane, 4,4'-thiodiphenol, 4,4'-thiobis(3-methyl-6-tert-butylphenol), methyl 4-hydroxybenzoate, ethyl 4-hydroxybenzoate, benzyl 4-hydroxybenzoate, tolylmethyl 4-hydroxybenzoate, phenethyl 4-hydroxybenzoate, 3-phenylpropyl 4-hydroxybenzoate, phenyl 4-hydroxybenzoate, 4-hydroxyacetophenone, 4-hydroxybenzophenone and salicylanilide. Benzyl 4-benzyloxybenzoate is used, for example in an amount of 0.01 to 1 part by weight per part by weight of such phenolic compound.

In addition to benzyl 4-benzyloxybenzoate, stearamide may be used combinedly therewith.

The thermoresponsive recording paper sheet in accordance with the present invention can be prepared by comminuting the chromogenic substance, the phenolic compound and benzyl 4-benzyloxybenzoate, each singly or in combination of benzyl 4-benzyloxybenzoate with the chromogenic substance and/or with the phenolic compound, together with a surfactant and/or binder in water, for example in a ball mill or sand grinder and coating a paper sheet with the resulting aqueous dispersions by a conventional method, followed by drying.

The following examples illustrate the present invention in more detail. "Part(s)" means "part(s) by weight."

COMPARATIVE EXAMPLE

Dispersion A

Crystal violet lactone: 1 part
5% Polyvinyl alcohol solution: 5 parts
Water: 40 parts

Dispersion B 4,4'-Isopropylidenediphenol: 5 parts

5% Polyvinyl alcohol solution: 25 parts
Water: 20 parts

EXAMPLE 1

Dispersion A

Same as Dispersion A in Comparative Example: 46 parts

Dispersion B 4,4'-Isopropylidenediphenol: 4 parts
Benzyl 4-benzyloxybenzoate: 1 part
5% Polyvinyl alcohol solution: 25 parts
Water: 20 parts

EXAMPLE 2

Dispersion A

Same as Dispersion A in Comparative Example: 46 parts

Dispersion B

Benzyl 4-hydroxybenzoate: 4.75 parts
Benzyl 4-benzyloxybenzoate: 0.25 part
5% Polyvinyl alcohol solution: 25 parts
Water: 20 parts In each of the above examples, Dispersions A and B were prepared separately (i.e. without mixing Dispersion A with Dispersion B) by dispersing the solid component by grinding in a ball mill for 2 days and then combined to give a coating composition for making a thermoresponsive recording paper sheet. A sheet of fine quality paper having the basis weight of 50 g/m$^2$ was coated on one side with the coating composition to the coat amount of 4 g/m$^2$ (on the dried basis) and dried at 50° C. in a drier. The thermoresponsive paper sheet thus obtained was caused to produce a color by pressing the sheet against a plate heated at 80°–150° C. under the pressure of 1.5 kg/cm$^2$ (gauge) for 5 seconds. The intensity of color was measured with a photoelectric densitometer. The results obtained are shown diagramatically in the FIGURE in the accompanying drawing. In the FIGURE, curve (1) is for the thermoresponsive sheet of Comparative Example, curve (2) for that of Example 1 and curve (3) for that of Example 2.

EXAMPLE 3

In Disperions B in Example 1 and Example 2, the proportion of benzyl 4-benzyloxybenzoate to the phenolic compound was varied as specified below in Table 1 while the total amount of the two components was retained, and thermoresponsive recording paper sheets were prepared in the same manner as in Examples 1 and 2.

TABLE 1

| | Thermoresponsive sheet No. | | | | | | | | | |
|---|---|---|---|---|---|---|---|---|---|---|
| Compound | 1 | 2 | 3 | 4 | 5 | 6 | 7 | 8 | 9 | 10 |
| Compound A | 2 | 2 | 2 | 1 | 1 | 1 | 0.5 | 0.5 | 0.5 | 0 |
| Phenol I | 3 | | | 4 | | | 4.5 | | | 5 |
| Phenol II | | 3 | | | 4 | | | 4.5 | | |
| Phenol III | | | 3 | | | 4 | | | 4.5 | |

Compound A: Benzyl 4-benzyloxybenzoate (m.p. 116° C.)
Phenol I: 4,4'-Isopropylidenediphenol
Phenol II: Benzyl 4-hydroxybenzoate
Phenol III: Phenethyl 4-hydroxybenzoate When recording was carried out on a thermal printer, the thermoresponsive recording sheets Nos. 1–9 produced distinct images with good dynamic responsiveness.

EXAMPLE 4

Dispersion A

3-Diethylamino-6-methyl-7-anilinofluoran: 1 part
5% Polyvinyl alcohol solution: 5 parts
Water: 40 parts Dispersion B Same as Dispersion B in Example 1: 50 parts

EXAMPLE 5

Dispersion A

Same as Dispersion A in Example 4: 46 parts

Dispersion B

Same as Dispersion B in Example 2: 50 parts

Using Dispersions A and B of Example 4 or 5, thermoresponsive recording paper sheets were prepared in the same manner as in Examples 1 and 2. The sheets, when recording was performed by means of a thermal printer, gave distinct images with good light resistance at high degrees of dynamic responsiveness.

While the invention has been described in detail and with reference to specific embodiments thereof, it will be apparent to one skilled in the art that various changes and modifications can be made therein without departing from the spirit and scope thereof.

What is claimed is:

1. A thermoresponsive recording paper sheet comprising a paper substrate and a thermoresponsive recording layer on said substrate, wherein said thermoresponsive recording layer comprises at least one normally colorless or pale-colored chromogenic substance in combination with at least one phenolic compound and benzyl 4-benzyl-oxybenzoate as a responsiveness-increasing agent.

2. A thermoresponsive recording paper sheet according to claim 1, wherein the phenolic compound is 4,4'-isopropylidenediphenol.

3. A thermoresponsive recording paper sheet according to claim 1, wherein the phenolic compound is benzyl 4-hydroxybenzoate.

4. A thermoresponsive recording paper sheet according to claim 1, wherein the chromogenic substance is a fluoran compound.

5. A thermoresponsive recording paper sheet according to claim 4, wherein the fluoran compound is 3-diethylamino-6-methyl-7-anilinofluoran.

6. A thermoresponsive recording paper sheet according to claim 1, wherein the chromogenic substance is crystal violet lactone.

* * * * *